US008708058B2

(12) United States Patent
Sinnerstad et al.

(10) Patent No.: US 8,708,058 B2
(45) Date of Patent: Apr. 29, 2014

(54) METHOD AND AN ARRANGEMENT FOR CONTROLLING A ROCK DRILL

(75) Inventors: Jonas Sinnerstad, Örebro (SE); Magnus Olsson, Hallsberg (SE); Marcus Leü, Fjugesta (SE)

(73) Assignee: Atlas Copco Rock Drills AB, Orebro (SE)

( * ) Notice: Subject to any disclaimer, the term of this patent is extended or adjusted under 35 U.S.C. 154(b) by 565 days.

(21) Appl. No.: 12/737,870

(22) PCT Filed: Oct. 9, 2009

(86) PCT No.: PCT/SE2009/051137

§ 371 (c)(1), (2), (4) Date: Feb. 23, 2011

(87) PCT Pub. No.: WO2010/042050

PCT Pub. Date: Apr. 15, 2010

(65) Prior Publication Data

US 2011/0147084 A1 Jun. 23, 2011

(30) Foreign Application Priority Data

Oct. 10, 2008 (SE) ..... 0802169

(51) Int. Cl.
*E21B 7/24* (2006.01)
*E21B 4/00* (2006.01)

(52) U.S. Cl.
USPC ..... 173/1; 173/8; 173/9; 173/10; 173/11; 173/19; 173/5

(58) Field of Classification Search
USPC ..... 173/1, 8–11, 13–14, 19, 105, 5
See application file for complete search history.

(56) References Cited

U.S. PATENT DOCUMENTS

| | | | | |
|---|---|---|---|---|
| 3,823,784 | A * | 7/1974 | Feucht | 173/1 |
| 3,979,944 | A * | 9/1976 | Salmi et al. | 173/8 |
| 4,246,973 | A * | 1/1981 | Mayer | 173/8 |
| 4,699,223 | A * | 10/1987 | Noren | 175/40 |
| 6,732,813 | B1 * | 5/2004 | Eklof | 173/1 |
| 6,938,702 | B2 | 9/2005 | Saha et al. | |

FOREIGN PATENT DOCUMENTS

| | | |
|---|---|---|
| WO | WO 97/49895 | 6/1997 |
| WO | WO 99/47313 | 3/1999 |
| WO | WO 00/08303 | 8/1999 |
| WO | WO 2006/032733 | 3/2006 |
| WO | WO 2006/032733 A1 | 3/2006 |
| WO | WO 2006/108918 | 4/2006 |
| WO | WO 2008/127171 | 4/2008 |
| WO | WO 2008/127172 | 4/2008 |

* cited by examiner

*Primary Examiner* — Michelle Lopez
(74) *Attorney, Agent, or Firm* — Mark P. Stone

(57) ABSTRACT

An arrangement and a method for controlling at least one drill parameter when drilling in rock with a rock drill, comprising an impulse-generating device arranged to induce shock waves in a tool acting against the rock with a percussive force generated via a shock wave-generating pressure. The arrangement and method comprises a control system for determining a first parameter value representing the damping pressure, determining a second parameter value representing the rotation pressure of a drill bit, determining a deviation between the second parameter value and a rotation pressure reference value, determining a parameter reference value depending on the deviation, and regulating the percussion pressure based on a function of the deviation and the parameter reference value.

20 Claims, 5 Drawing Sheets

METHOD AND AN ARRANGEMENT FOR CONTROLLING A ROCK DRILL

TECHNICAL AREA

The present invention concerns a method in accordance with the introduction to claim 1 and an arrangement in accordance with the introduction to claim 11 for controlling drill parameters when drilling in rock. The invention also concerns a computerised control system comprising means to carry out the method. The invention also comprises a drilling rig, including a control system in accordance with the invention.

THE PRIOR ART

When drilling rock, percussion drilling is often used. A impact piston, usually hydraulically driven, is used to create a shock wave with a percussive force generated with hydraulic pressure, the percussion pressure, the pressure that generates the shock wave. The shock wave (energy) is transported via a drill steel (drill pipe) to a drill bit and on to the rock. Where it strikes the rock, a tungsten carbide pin in the drill bit in contact with the rock is pressed into the rock, generating a force sufficient to crush the rock. The crushed rock, usually called drill cuttings, is then transported out of the drill hole with water or air pressure that is fed down to the drill bit via a hole in the drill steel. In order that the tungsten carbide pin comes into contact with uncrushed rock, the drill steel is rotated. This is done using a gear and a hydraulic motor.

During drilling, it is important for the drill bit to have optimum contact with the rock. For this reason, the rock drill is pressed against the rock. The rock drill may, for example, be fixed to a saddle which, in turn, runs along a carrier device such as a feed beam fixed to a carrier such as a vehicle. The rock drill and the saddle are driven against the rock along the feed beam with a hydraulic cylinder, defined as the feed cylinder, and the drill bit is thus pressed against the rock. An alternative means of driving the rock drill forwards is to use a chain feeder, in which the feed cylinder is replaced with a hydraulic motor, fitted with a gearwheel, that is mounted at the very rear of the feeder. By means of a chain that is fixed to the saddle and a gearwheel at the very front of the feeder, the saddle moves forwards and backwards with the rock drill. The hydraulic pressure fed to the feed cylinder or the hydraulic motor on the chain feeder is defined as the feed pressure in this text.

Different rock types present different levels of drilling difficulty, depending on the minerals of which they consist and their structure. In general, an increase in drilling speed indicates that the rock is becoming softer. This relation is utilised, for example, in the document EP1102917B1, which describes how the percussion pressure is controlled in proportion to the feed pressure so that the percussion pressure is reduced to a start drilling level when the rock drill enters an area with softer rock in which less percussion energy is required to cut the rock. However, this regulation can lead to a decrease in production if the regulation is adjusted with excessive sensitivity to achieve a long life.

It is also important to maintain good contact with the rock under these difficult rock conditions, particularly when drilling with high percussive force. Therefore, a damping system arranged to ensure that good rock contact is maintained has been developed. The contact pressure of the drill bit against the rock is thus affected via the feed pressure via a damping piston arranged in the damping system, which is arranged to generate a damping force in the damping system with a hydraulic pressure (damping pressure). During drilling, the damping piston is pressed against the drill steel, and thus the drill steel against the rock, by means of the pressurisation of a pressure chamber acting on the damping piston. The damping piston is usually arranged in such a way that, if the damping piston comes too far forwards, i.e. the area in front of the drill steel is so soft that the stroke of the impact piston makes the drill steel, and thus the damping piston, move forwards and past a normal position, an outlet for the above pressure chamber opens fully or partially, thus producing a reduction in pressure in the pressure chamber. The damping system also protects the rock drill by damping percussion impulse reflections from the rock.

Examples of problems that may occur in connection with drilling include hole deviation and hole curvature. Hole deviation occurs, for example, on account of angular deviation of the drill steel in connection with collaring, the stage at which a new hole is started, and can usually be remedied by the operator. Hole deviation, i.e. the hole deviates and becomes curved instead of rectilinear, as intended, is more difficult for the operator to handle. There may be several causes of hole deviation, for example the drill bit reaches a section with alternating harder and softer rock types with a plane of division at an angle to the direction of drilling. Hole deviation may also occur when there are cracks in the rock and cavities that may be full of water or clay, which renders continuous rock contact difficult. Other causes of hole deviation may be that the drill bit has not been properly ground and/or in combination with the length of the drill steel having reached its breaking length.

Another problem that may occur in connection with drilling with poor rock contact is that the drill pipe's drill steel, which is usually joined with threaded connections, is at risk of becoming unscrewed so that the threaded connections cease to be tightened during drilling. This results in the possibility of damage to contact surfaces between the male and female threads. For example, the contact surfaces may be spotwelded together in places by the friction heat, producing an incipient fracture on the threads, which may result in the drill steels breaking.

There is thus a need for an improved method and arrangement for controlling drill parameters that at least alleviate the problems with the prior art.

DESCRIPTION OF THE INVENTION

A first aim of the present invention is to provide a method for controlling at least one drill parameter that solves the above problems.

The solution is a method as disclosed herein.

Such a method for controlling at least one drill parameter when drilling in rock with a rock drill, comprising an impulse-generating device arranged to induce shock waves in a tool acting against the rock with a percussive force generated via a percussion pressure, a rotation-generating device arranged to supply a torque to the impact device with a rotation generated via a rotation pressure, and a pressurisable damping chamber arranged to at least partially regulate the rock drill's contact with the rock via a damping pressure in the damping chamber, involving determining a first parameter value representing one of the following: the damping pressure, a feed pressure achieving the forward feed of the rock drill, determining a second parameter value representing the rotation pressure of the drill bit, determining a deviation between the above second parameter value and a rotation pressure reference value, determining a parameter reference value for the first parameter value depending on the above deviation, in which connection the parameter reference value is a damping pressure reference value if the first parameter value is the damping pressure and the parameter reference value is a feed pressure reference value if the first parameter value is the feed pressure, regulating the percussion pressure based on a function of the above first parameter value and the above parameter reference value.

This has the advantage that, by regulating the percussion pressure as a function of the rotation pressure and the pressure in a damping chamber, it is possible to ensure in every situation that a correct percussion pressure is used in relation to the damping pressure and the rotation. Alternatively, by regulating the percussion pressure as a function of the rotation pressure and the feed pressure, it is possible to ensure in every situation that a correct percussion pressure is used in relation to the feed pressure and the rotation.

This is achieved in that, when the rotation pressure is at a high level and the feed pressure is reduced, it is also possible to correct the relation between the damping pressure and the percussion pressure in an appropriate manner.

According to an embodiment of a method according to the invention, the percussion pressure is regulated in such a way that it reflects changes in the above rotation pressure. According to a preferred embodiment of a method according to the invention, the method also includes the step of allowing the percussion pressure to maintain normal drilling pressure when the first parameter value is greater than the parameter reference value and the second parameter value is greater than a rotation pressure reference value.

According to an embodiment of a method according to the invention, the percussion pressure is regulated in relation to the mean values of the rotation during an interval of time.

By monitoring the rotation pressure and combining this with regulation of the percussion pressure based on the damping pressure, it is possible to achieve more sensitive operation so that the risk of hole deviation is reduced, while also making it possible to avoid a decrease in productivity in connection with hole deviation on account of reduced percussion pressure. When the high rotation pressure reduces the regulation level for the damping pressure, the relation between feed pressure and percussion pressure will be reduced. This will produce an increased opportunity to handle the situation when the drill bit reaches a plane of division, above all when the rock goes from soft to hard. When the rotation pressure has a higher level than is considered normal, there is very little risk of the threads on the drill steels coming undone, even if the rock contact is not adequate. This allows a higher percussion pressure to be approved. This function also contributes to the achievement of straighter holes when drilling in cracked rock. The direction of the drill bit can be maintained better as a higher percussion pressure is used for crack drilling.

The present invention has a number of advantages, for example the service life of drill bits, drill steels (drill pipes) and shank adapters is increased. This advantage is achieved by the harmful reflections being reduced as stricter regulation levels can be set and the percussion pressure is regulated depending on the rotation pressure and the rock contact of the drill bit. Another advantage is that there is less damage to threaded connections. Another advantage of the present invention is that a considerably more flexible system is achieved.

According to an embodiment of a method according to the invention, the method includes the step of regulating the percussion pressure in relation to the collaring pressure when the first parameter value is less than the parameter reference value.

According to an embodiment of a method according to the invention, the method also comprises the step of setting a guideline value for the percussion pressure depending on the above function and regulating the percussion pressure depending on the guideline value.

According to an embodiment of a method according to the invention, the rotation pressure is determined continuously and/or at specific intervals via sensing, monitoring, measurement or calculation. By determining the above pressure continuously, it is possible to carry out continuous regulation of the percussion pressure. Also filtering the values of the pressure determined generates the advantage that the regulation is less sensitive to small fluctuations.

According to an embodiment of a method according to the invention, the regulation is carried out by means of a mathematical relation between the damping pressure or feed pressure and the rotation pressure and the percussion pressure and/or by looking it up in a predetermined table.

According to an embodiment of a method according to the invention, the regulation is carried out by means of a mathematical relation between the feed pressure, the rotation pressure and the percussion pressure and/or by looking it up in a predetermined table.

According to an embodiment of a method according to the invention, the function consists of one of the following or a combination of several of the following: proportional regulation, integral regulation, derivative regulation in relation to the above deviation and/or the above parameter reference value, one of the following: damping pressure reference value, feed pressure reference value.

According to an embodiment of a method according to the invention, the method also involves the above percussion pressure increase being regulated in such a way that the percussion pressure increase per time unit is kept below a threshold value.

According to an embodiment of a method according to the invention, the rotation-generating device comprises a rotation motor and the second parameter value is a mean value of the rotation pressure during a fixed period of time.

According to an embodiment of a method according to the invention, the method also involves the above impulse-generating device being mobile forwards and backwards along a feed beam regulated by a feed pressure and the above feed pressure being regulated depending on the rotation pressure.

A second aim of the present invention is to provide an arrangement for controlling at least one drill parameter that solves the above problems.

The solution is an arrangement that has the characteristics in claim 11.

Such an arrangement for controlling at least one drill parameter when drilling in rock with a rock drill comprises an impulse-generating device arranged to induce shock waves in a tool acting against the rock with percussive force generated via a percussion pressure, a rotation-generating device arranged to supply a torque to the impact device with a rotation generated via a rotation pressure, a pressurisable damping chamber arranged to at least partially regulate the rock drill's contact with the rock via the prevailing pressure in the damping chamber, in which connection the percussion pressure is regulated depending on the pressure in the above damping chamber, and a control system arranged to control the movement of the rock drill, in which connection the arrangement comprises devices arranged to carry out the methods in accordance with any of claims 1-10.

Such an arrangement possesses advantages equivalent to those described above.

The invention also comprises a computerised control system that comprises means of carrying out a method of controlling at least one drill parameter when drilling in rock in accordance with any of the methods in claims 1-10.

The invention also comprises a computer program that can be downloaded directly to a computer's internal memory, which program comprises program code for controlling a method in accordance with any of the methods in claims 1-10.

The invention also comprises a computer-readable medium with a computer program loaded onto it, which computer program is designed to make a computer carry out steps in accordance with the method in any of claims 1-10.

The invention also comprises a drilling rig, comprising a computerised control system in accordance with claim 11.

The below description and claims contain advantageous further developments of the invention.

DESCRIPTION OF DRAWINGS

The invention will be explained in further detail via descriptions of embodiments with reference to the attached drawings, in which.

DESCRIPTION OF EMBODIMENTS

The following description describes an underground rig. However, the invention can also be applied to a surface rig.

Figure 1:
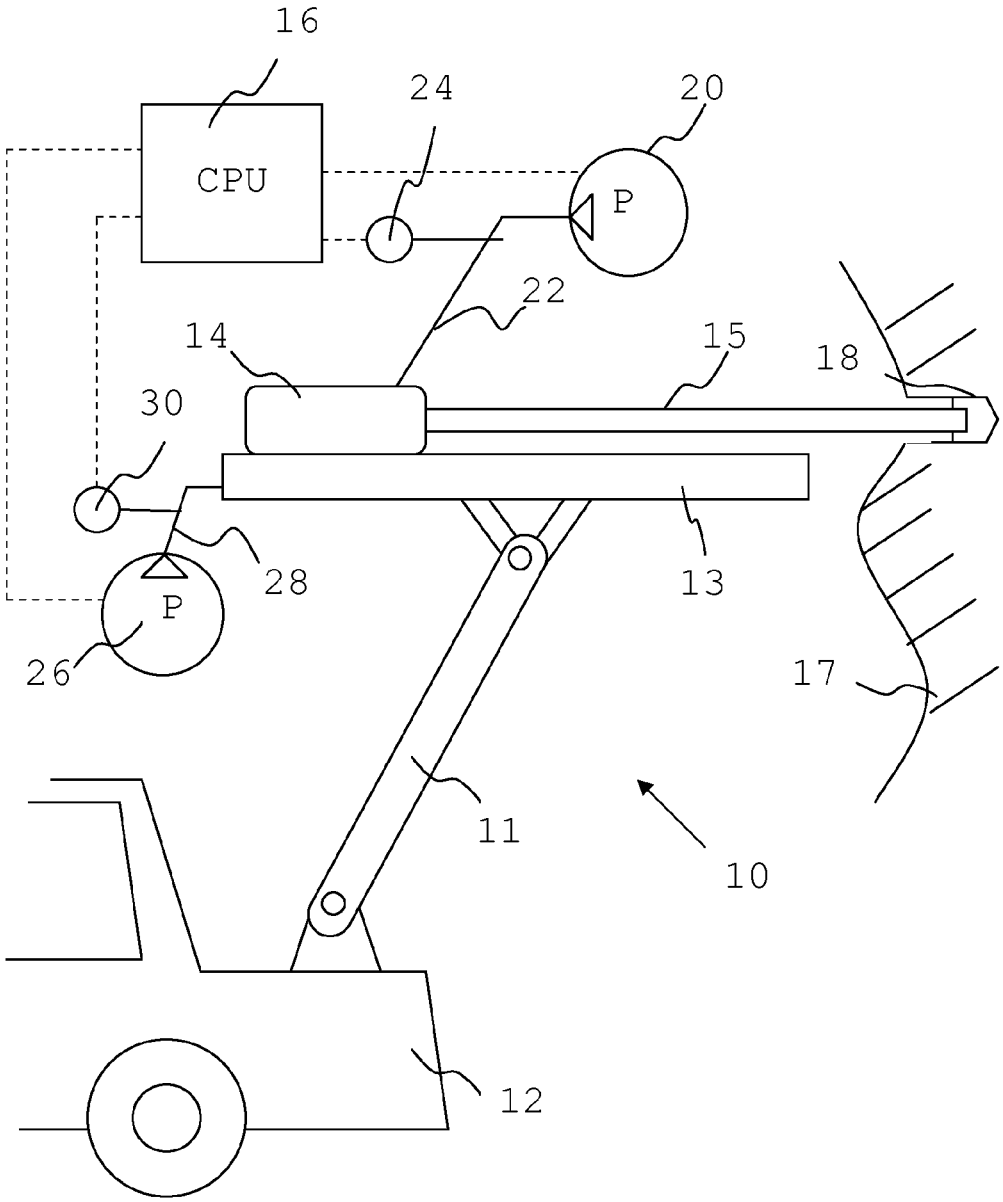
FIG. 1 shows an outline of a drilling rig equipped with an arrangement according to the present invention.

FIG. 1 shows a rock drilling rig 10 for tunnelling, ore mining or installation of rock reinforcement bolts in connection with, for example, tunnelling or mining. The drilling rig 10 includes a boom 11, one end 11*a* of which is attached in articulated fashion to a carrier 12, such as a vehicle, via one or more articulation devices and at the other end 11*b* of which is arranged a feeder 13 that supports an impulse-generating device in the form of a rock drill 14. The rock drill 14 can be moved along the feeder 13 and generates shock waves that are transferred to the rock 17 via a drill pipe 15 and a drill bit 18. The rig 10 also comprises a control unit 16 which can be used to control drill parameters according to the present invention and according to that which will be described below. The control unit 16 can be used to monitor position, direction and distance drilled, etc. in respect of the rock drill and carrier. The control unit comprises a microprocessor or a processor comprising a central processing unit (CPU) or a field-programmable gate array (FPGA) or a semiconductor unit comprising programmable logic components and programmable communication units that regulate the rock drill's functions with control functions and carry out steps according to the method according to one aspect of the invention. This is done by means of one or more computer programs that are stored at least partially in a memory that is accessible to the control unit. The control unit 16 can also be used to control the movement of the rig 10, although a separate control unit can, of course, be used for this.

The rock drill 14 comprises, in a manner belonging to the prior art, a rotation device (not shown) arranged to rotate the drill pipe 15 during drilling. The rotation device comprises a rotation motor that is driven hydraulically via a rotation liquid flow that emanates from a first pump 20 via a first pipe 22. The pressure in the pipe 22 is the rotation pressure R that is measured with a first pressure sensor 24. The control unit 16 receives signals from the first pressure sensor 24 and thus monitors and registers the pressure in the first pipe 22. The rotation pressure R is measured continuously and/or at specific intervals via sensing, monitoring, measurement or calculation. The pressure sensor 24 can also, in another embodiment not shown, measure the rotation pressure R in the rotation motor. The rock drill is driven forwards with a feed force by a feed motor (not shown) that is driven hydraulically via a feed flow that emanates from a second pump 26 via a second pipe 28. The pressure in the feed pipe 28 is the feed pressure M that is measured with a second pressure sensor 30. The control unit 16 receives signals from the pressure sensor and thus monitors and registers the pressure in the second pipe 28. The position and speed of the rock drill are determined by means of a position sensor (not shown) on the feeder 13 connected to the control system 16. The speed of the rock drill and saddle during the time when there is no drilling is called the feed speed here. The speed of the rock drill and saddle during drilling is called the drill speed here.

Via a percussion mechanism (not shown) inside the rock drill, percussion pulses are transferred to the drill pipe (drill steel) and from there to the rock via the percussion mechanism striking an adapter (not shown) fixed to the drill pipe 15 distal to the drill bit. The percussion mechanism is driven with a percussion pressure S (shock wave-generating pressure). The rock drill also comprises a damper system. The drill pipe 15 is fed towards the rock via a damping piston (not shown) arranged in the damper system. In addition to the above function of pressing the drill pipe against the rock, the damping piston also has a damping function.

Figure 2:
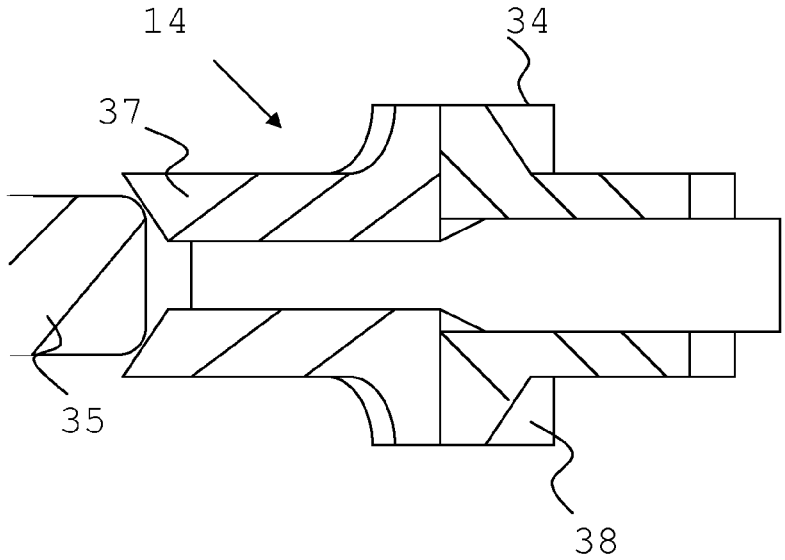
FIG. 2 shows a flow damper according to the prior art.

FIG. 2 shows the damper system in more detail. The drill pipe 15 is fed towards the rock via a damping piston 34, a flow damper in this case, arranged in the damper system. The drill pipe is fed towards the rock via a sleeve 37 by means of the damping piston 34, in which connection the damper 34 strikes the adapter 35. In operation, a force determined by a hydraulic pressure in a pressurisable damping chamber 38 is transferred to the adapter 35 via the damping piston 34 and sleeve 37. The above force is used to ensure that the drill bit is kept permanently pressed against the rock. The damping piston is also arranged in such a way that, if it is displaced in the direction of drilling in relation to a normal position, for example to a new position, which may, for example, be the case if the drill bit reaches a cavity, or if a harder rock type becomes a looser rock type, in which cases the strokes of the impact piston strike away the drill pipe, a reduction in pressure is achieved in the damping chamber 38.

The hydraulic pressure in the damping chamber 38 is the damping pressure D that is measured with a third pressure sensor, not shown. The control unit 16 receives signals from the third pressure sensor and thus monitors and registers the damping pressure. By measuring the damping pressure (alternatively, the damping pressure in the damping chamber may be represented by a pressure that is measured/determined in or at a pressure feed pipe to the damping chamber 38) D, the control unit 16 can determine the extent to which the drill bit is in contact with the rock and the position of the damping piston relative to the normal position. The hydraulic pressure in, or in a feed pipe to, the damping chamber 38 is utilised as a first control function for regulation of the percussion pressure as a function of the damping pressure and time in order to achieve good rock contact.

In another embodiment, not shown, a damping chamber comprising two damping chambers can also be used.

Figure 3:
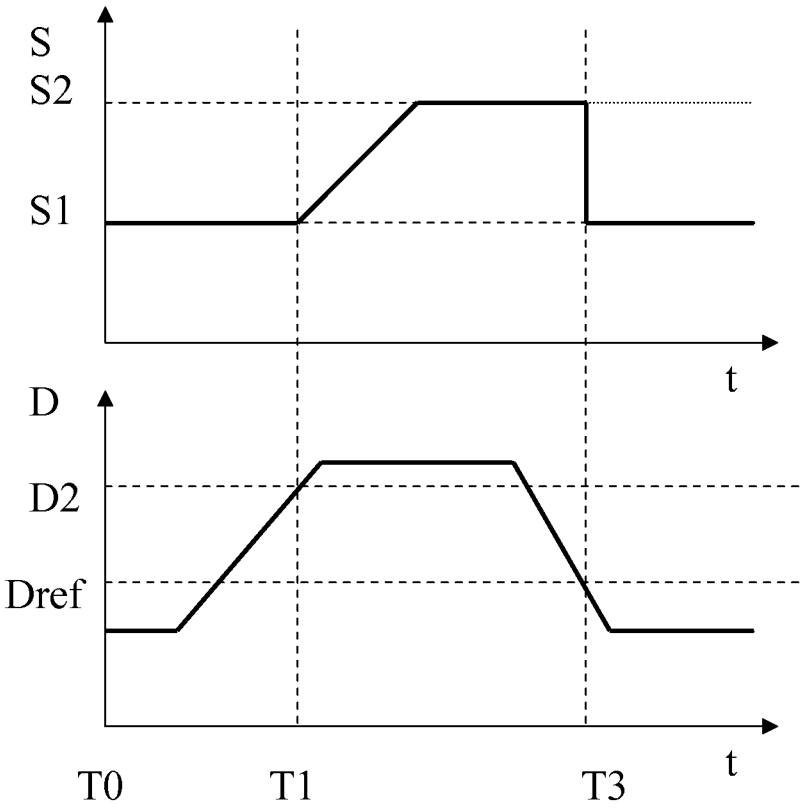
FIG. 3 shows an example of regulation of damping and percussion pressure as a function of time.

FIG. 3 shows an example of such regulation. The first control function involves reducing the percussion pressure when the damping pressure falls, which results in the shank adapter having been pressed forwards and the rock contact being poor, and increasing the percussion pressure when the damping pressure is high and when the rock contact is considered to be good. The first control function thus makes it possible to switch between different damping pressure levels in a controlled fashion. A number of limit values for the damping pressure D are defined in the control system: a damping pressure reference value Dref, equivalent to the damping pressure permitted when only a low percussion pressure S1 is permitted, and a second damping pressure D2, equivalent to the damping pressure permitted when a high percussion pressure S2 is permitted. The basic principle of the first control function is regulation of the percussion pressure as a function of the damping pressure. The damping pressure Dref may, for example, consist of a level at which the percussion pressure is reduced to the start drilling level, the collaring pressure, in order that the equipment is not damaged if contact with the rock is lost as the shock wave impulse is then not transferred to the rock and is reflected back within the rock drill instead. The second damping pressure D2 may, for example, consist of a pressure at which the rock contact is considered to be good, and a high percussion pressure can therefore be accepted as the risk of damaging the equipment is lower as the shock wave impulse is thus transferred effectively.

In this case, the percussion is regulated so that it can maintain normal drilling pressure S2 when the damping pressure is in the interval between the damping pressure reference value Dref1 and high damping pressure D2. FIG. 3 shows how the percussion pressure is maintained at a collaring (start drilling) level S1 at the start of drilling and for as long as the damping pressure is lower than the higher level D2. When the damping pressure, at a time T1, exceeds the pressure level D2, the percussion pressure is increased to normal drilling pressure S2, at which the percussion pressure is then maintained for as long as the damping pressure is not lower than the lower damping pressure level, damping pressure reference value Dref1. At a later time T3, the damping pressure reference value is lower than the pressure level Dref1 and the percussion pressure is thus lowered to the start drilling level S1. The reduction takes place as a step function in this case but other functions can also be used in other embodiments, for example a proportional function or a ramp function. In the same way, the percussion pressure is increased in accordance with different functions, for example a step function, a proportional function or a ramp function.

Figure 4:
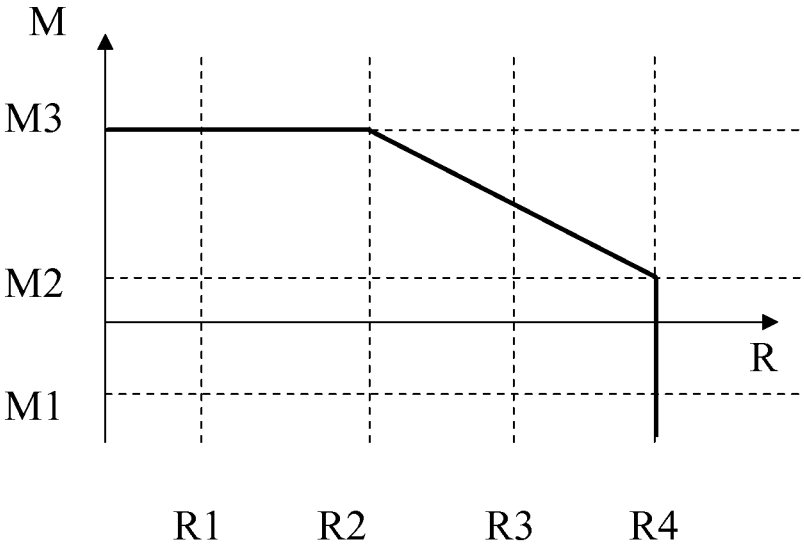
FIG. 4 shows an example of regulation of feed pressure as a function of rotation pressure.

Despite regulation with the above first control function, with drilling there is a risk of the drill jamming. Therefore, a second control function has been implemented in the control system as shown in FIG. 4. Jamming means that it is hard to release the drill rod so that the drill rod has to be left in the drill hole in the rock, which, in itself, causes a reduction in production. If a drill rod has to be left, a problem arises in addition to the cost of the rod and the drill bit, plus difficulties in connection with loading. There is also a risk that the remaining drill bit will disturb the continued drilling or processing of blasted rock afterwards when it is crushed as the drill bit contains harder material such as tungsten carbide that may damage the equipment. Often when the rock drill is on the way to jamming, the rotation pressure R to the rotation motor increases as higher torque is required to rotate the drill bit.

In FIG. 4, the horizontal axis describes the rotation pressure and the vertical axis describes the feed pressure. The second control function regulates the feed pressure as a function dependent on the rotation pressure R. The feed pressure of the feed motor/feed cylinder in this case is directly proportional to the feed force. A number of rotation pressures are defined in the control system, such as different levels for the rotation pressure: a minimum rotation pressure R1, a setpoint value for the rotation pressure R2, a limit value for the rotation pressure R3 after jamming, which rotation pressure is higher than the setpoint value R2, and a maximum permitted rotation pressure R4. The minimum rotation pressure R1 is equivalent to idling for the rotation motor when the rock drill is activated but without load. The setpoint value for rotation pressure R2 is equivalent to an assumed rotation pressure for the rock type in question, which is equivalent to a level at which the threaded connections on the drill pipe hold together.

The maximum permitted rotation pressure R4 is defined as a pressure just before the pressure equivalent to a level at which the threaded connections are tightened so much that they can no longer be undone. If the maximum permitted rotation pressure R4 is achieved, the control system activates an anti-jamming function. The anti-jamming function reverses the rock drill until the rotation pressure is lower than the rotation pressure after jamming R3. The equivalent feed pressure is: a feed pressure in connection with jamming M1, a limit value for the feed pressure M2 and a setpoint value for the feed pressure in connection with normal drilling M3.

In FIG. 4, the rock drill starts with the idling rotation pressure R1 and, for as long as normal drilling is carried out, the rotation pressure is lower than the setpoint value for the rotation pressure R2. In the figure and in the control system, the interval between the idling rotation pressure R1 and the setpoint value for the rotation pressure R2 is equivalent to the feed pressure in connection with normal drilling M3. If, for any reason, the rock drill starts to jam, the rotation pressure increases as mentioned above. If, in this connection, the rotation pressure passes the setpoint value for the rotation pressure R2, the control system is arranged to reduce the feed pressure to the limit value for the feed pressure M2. In this case, the reduction in the feed pressure takes place proportionally to the rotation pressure. However, the reduction in the feed pressure may also take place in accordance with other mathematical functions.

The pressure level for the limit value for feed pressure M2 is usually fixed at a level at which the friction is just overcome and the rock drill begins to move. The aim, in connection with this level, is to reduce the rock contact somewhat for the drill bit and thus reduce the risk of the rock drill jamming and of the threaded connections being tightened too much so that they cannot be undone. If, despite this, the rotation pressure continues to rise to the maximum permitted rotation pressure R4, the control system will activate the anti-jamming function and lower the feed pressure to the feed pressure in connection with jamming M1, in this example shown as a step function, which is achieved by reversing the rock drill. When the anti-jamming function is then activated, the feed pressure is regulated so that the drill saddle is fed backwards until the rotation pressure is lower than the rotation pressure after jamming R3. The negative axis for the feed pressure M, comprising M1, is thus equivalent to the rock drill reversing.

There are various embodiments of the function for regulating the feed pressure depending on the rotation pressure for various rig types such as surface or underground rigs. The regulation may, for example, be carried out according to a mathematical model such as proportional, derivative or integral regulation or some other prior art regulation.

When the first and second control functions described above are combined, the following situation may arise: the control system reads off an increasing rotation pressure R, which has the result that, when the rotation pressure has increased above the setpoint value for the rotation pressure R2, the system reduces the feed pressure M with the second control function. As the feed pressure M decreases, this causes the rock contact to deteriorate, with the result that the damping pressure D decreases and, dependent on this, the control system reduces the percussion pressure S with the first control function. This situation has the result that the reduced feed pressure M certainly contributes to reducing the risk of the drill steel being bent out towards the side of the drill hole, but if the drill bit strikes a plane of division between different rock types, there may be a risk of hole deviation as the ratio between the feed pressure and the percussion pressure is constant as both are reduced. Another consequence of this is that, unless the system succeeds in straightening the hole, there is a risk of the last part of the hole being drilled with collaring percussion pressure, which dramatically reduces the drilling speed and thus productivity.

The present invention will now be described in further detail with reference to FIG. 5 as an example of regulation of the percussion pressure in accordance with an embodiment of the invention that aims to increase the drilling speed and productivity.

Figure 5:
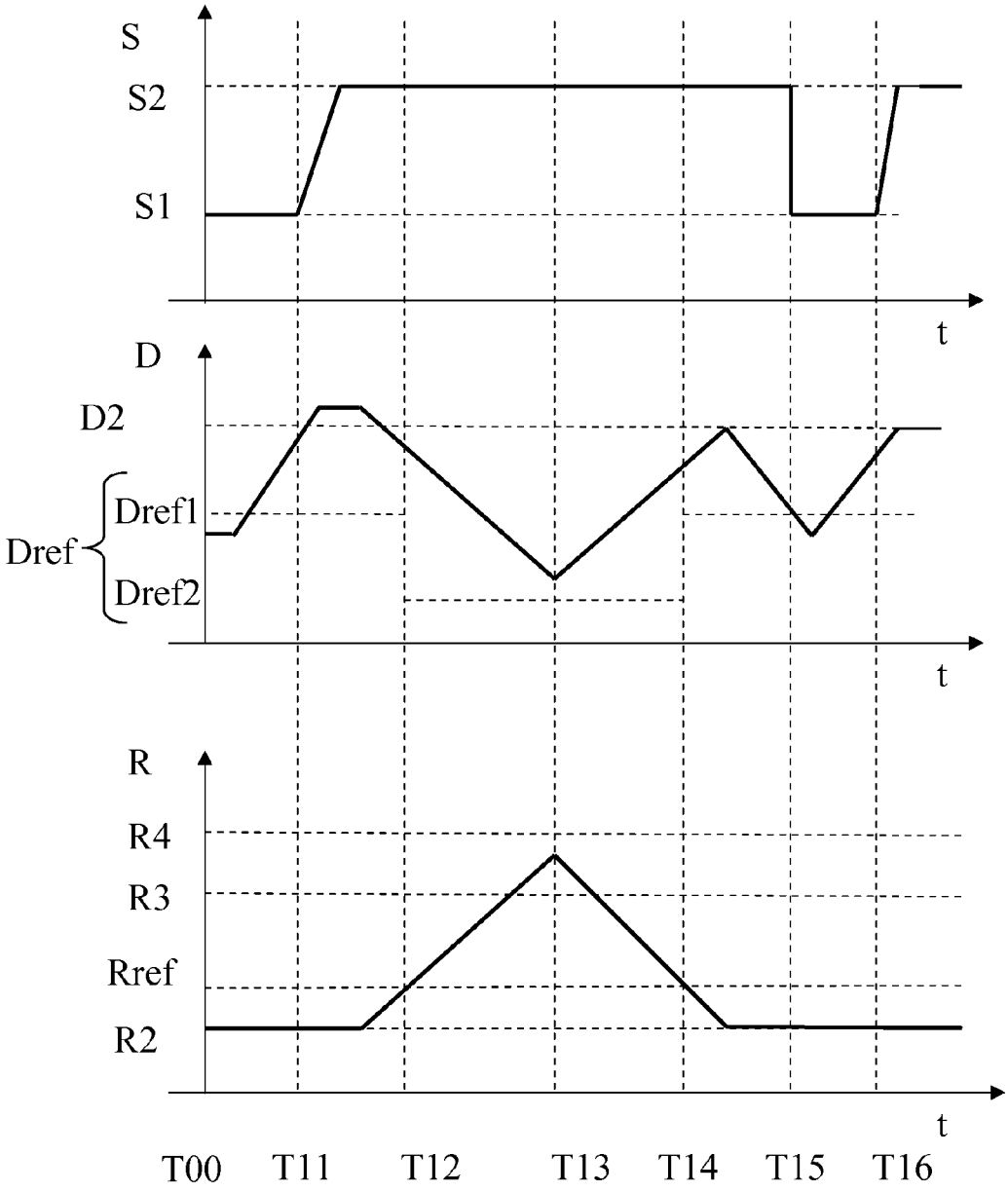
FIG. 5 shows an example of regulation of percussion pressure according to an embodiment of the present invention.

FIG. 5 shows a method in which the percussion pressure is regulated depending on the rotation pressure and damping pressure. The method is carried out in cooperation with the first and second control functions. The figure shows three graphs, representing percussion pressure S, damping pressure D and rotation pressure R as a function of a common time axis. In addition to the predefined limit values for rotation pressure mentioned in the description for FIG. 4, the control system also contains a rotation pressure reference value Rref, defined between the end positions for rotation drilling R1 and R4. In addition to the limit values for damping pressure defined in the description for FIG. 3, there is also a third limit value for damping pressure, another damping pressure reference value Dref that has a level for a second damping pressure reference value Dref2 defined, which damping pressure is lower than the first damping pressure reference value Dref1. There are thus two different damping pressure reference values Dref: (Dref1, Dref2). As mentioned above in the description for FIG. 3, there are two levels for the percussion pressure defined in the control system: the percussion pressure in connection with collaring S1 and the percussion pressure in connection with normal drilling pressure S2.

The method involves a first parameter value P1 representing the damping pressure D being determined. In addition, a second parameter value P2, representing the rotation pressure R of the drill bit, is determined. Subsequently, a deviation ΔR between the above second parameter value and a rotation pressure reference value Rref is determined. A parameter reference value is then determined, in this case a damping pressure reference value Dref depending on the above deviation ΔR. The percussion pressure is regulated based, therefore, on a function G(Dref(ΔR) of the above damping pressure reference value Dref.

The drilling in the example described in FIG. 5 begins at time T00 and starts with a percussion pressure S1 for collaring, damping pressure reference value Dref1 and setpoint value for rotation pressure R2. During the time shown in the interval between T00 and T11, the graph corresponds to the regulation with the first control function shown in FIG. 3 between times T0 and T1. This interval corresponds to normal drilling, which means that the rotation pressure is below or at the setpoint value for rotation pressure R2. In this case, the conditions for regulation according to the present method have not yet been met.

However, if the rotation pressure R increases so that the setpoint value for rotation pressure R2 is exceeded, the control system begins to reduce the feed pressure M in accordance with the second control function shown in FIG. 4. This also causes the damping pressure D to fall because the rock contact deteriorates in this connection. If the rotation pressure is higher than the rotation pressure reference value Rref, as shown at time T12 in FIG. 5, one of the conditions for activating the method described is also met. The control system thus regulates the percussion pressure based on the following method: the control system determines a first parameter value P1, representing the damping pressure D, and a second parameter value P2, representing the rotation pressure R of the drill bit. The control system then determines a deviation ΔR between the above second parameter value P2 and a rotation pressure reference value Rref and then determines the value that is to apply for the damping pressure reference value Dref depending on the above deviation ΔR. In this connection, the damping pressure reference value Dref is set either to the level of a first damping pressure reference value Dref1, if the rotation is lower than Rref, or the level of a second damping pressure reference value Dref2 if the rotation is higher than Rref. The percussion pressure is then regulated based on a function of the above deviation and the first parameter value P1.

In the embodiment shown in FIG. 5, this means that, when the rotation pressure reference value Rref has been reached, the conditions in connection with regulation of the percussion pressure are changed and the regulation level for the damping pressure reference value Dref is set to the level for the second damping pressure reference value Dref2 instead of the previous limit level for Dref equivalent to the first damping pressure reference value Dref1 described in FIG. 3. This means that, when the rotation pressure R increases, for example because the drill is becoming jammed and the feed pressure starts to be reduced as a result, the control system will maintain the percussion pressure at the level for the normal drilling pressure S2 instead of lowering the percussion pressure to the collaring pressure S1. When the rotation pressure again falls below the level for the rotation pressure reference value Rref (see point T14 in FIG. 5), the conditions in connection with regulation of the percussion pressure are changed and the regulation level for the damping pressure reference value Dref is returned to the level equivalent to the first damping pressure reference value Dref1.

FIG. 5 also shows how, when the drill bit strikes a cavity or part with loose rock, so that the damping pressure decreases without the rotation pressure increasing at the same time, the control system will reduce the percussion pressure depending on a damping pressure reference value Dref, with the level for the first damping pressure reference value Dref1 (see time T15 in FIG. 5). The percussion pressure is regulated in such a way that it reflects changes in the damping pressure. At time T16, the damping pressure returns to high damping pressure D2 and the percussion pressure is regulated again to increase.

The percussion pressure is regulated essentially in such a way that it reflects changes in the above rotation pressure. When the rotation pressure exceeds Rref, the regulation level for damping pressure D with the damping pressure reference value Dref switches between the levels for the first damping pressure reference value Dref1 and the level for the second damping pressure reference value Dref2. The rotation pressure may be determined continuously and/or at specific intervals via sensing, monitoring, measurement or calculation.

For example, the percussion pressure may be regulated as described above or as a function of rotation pressure and damping pressure, in which connection the above function consists of one of the following or a combination of several of the following: proportional regulation, derivative regulation, integral regulation in relation to the above deviation and/or the above damping pressure reference value or a combination of these. The method may also be carried out by means of a mathematical relation between the damping pressure, the rotation pressure and the percussion pressure and/or by looking it up in a predetermined table.

The increase in percussion pressure may also be regulated in such a way that the increase in percussion pressure per time unit is kept below a threshold value.

In another embodiment, the feed pressure regulates the percussion pressure. The first parameter value then represents a feed pressure instead. The percussion pressure is limited in this case if the first parameter value is lower than a feed pressure reference value Mref. The feed pressure reference value in this connection is set to either the level for a first feed pressure reference value Mref1 or the level for a second feed pressure reference value Mref2, lower than Mref1. The feed pressure reference value Mref is set, in a manner similar to that described above, depending on the deviation ΔR between the second parameter value P2 and a rotation pressure reference value Rref, as a function H(Dref(ΔR). If the rotation is lower than Rref, the feed pressure reference value is set to Mref1. If the rotation is higher than Rref, the feed pressure reference value Mref is reset to Mref2.

In yet another embodiment, the percussion pressure is regulated in relation to the collaring percussion pressure when the first parameter value P1 is lower than a parameter reference value, one of the following: damping pressure reference value, feed pressure reference value.

The percussion pressure is also limited if the first parameter value represents a damping pressure and is lower than the damping system's idling pressure.

In another embodiment, the percussion pressure is regulated in relation to a maximum percussion pressure when the first parameter value is higher than a parameter reference value, one of the following: damping pressure reference value, feed pressure reference value and the second parameter value is higher than a rotation pressure reference value.

The percussion pressure may, of course, be increased and decreased in accordance with different functions (not all shown here), for example a step function, a proportional function or a ramp function.

In another embodiment, a percussion pressure S is permitted that is higher than the normal drilling pressure S2, which has the advantage that drilling in, for example, cases where strata of significantly harder rock are interspersed in the rock drilled may be made easier.

Figure 6:
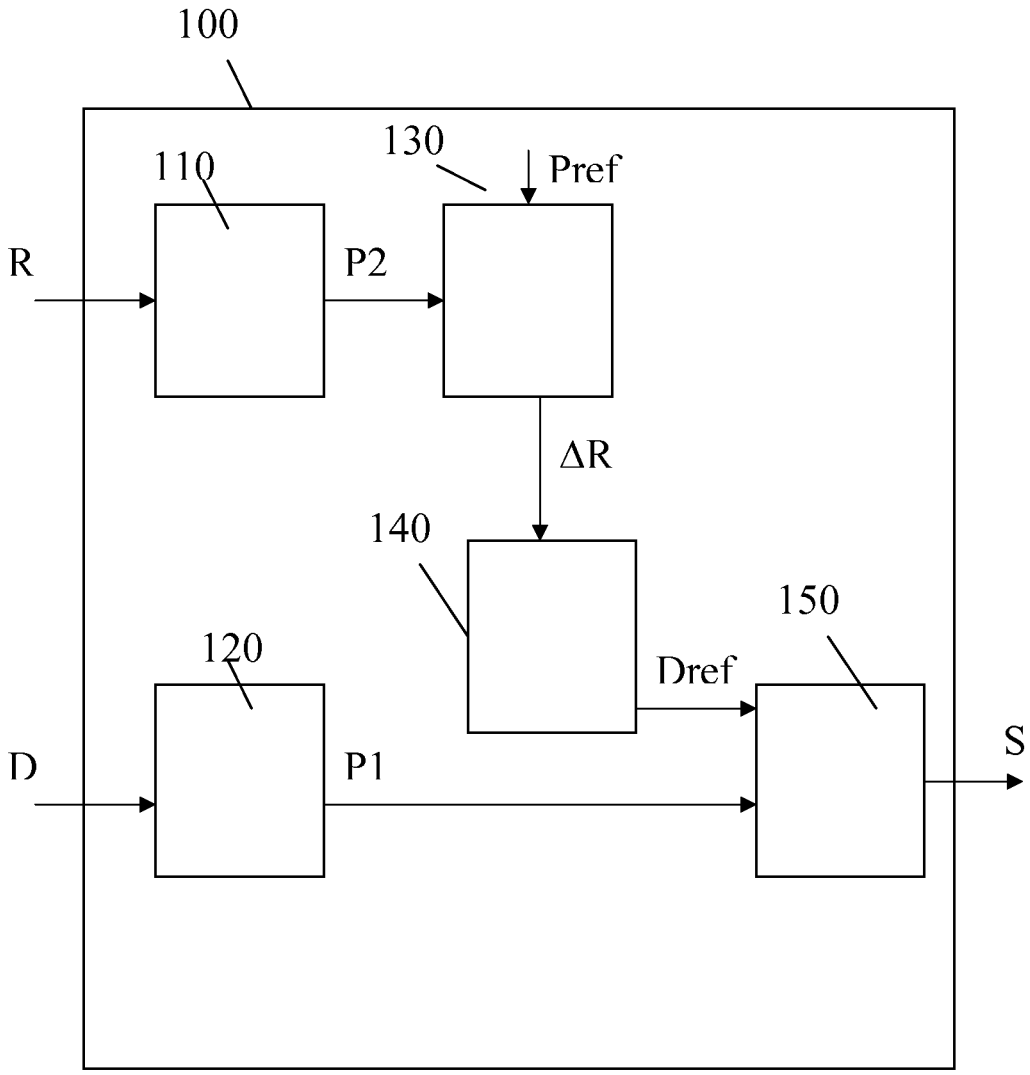

FIG. 6 shows an arrangement 100 as a detail of the control system (16) for regulation of percussion pressure in accordance with FIG. 5 when the first parameter is the rotation pressure.

The arrangement comprises a first device 110 to which signals are applied from the first pressure sensor 24 that measures the rotation pressure. The first device 110 is arranged to determine a second parameter value P2 representing the rotation pressure R. The arrangement also comprises a second device 120 to which signals are applied from the third pressure sensor that measures the damping pressure. The second device 120 is arranged to determine a first parameter value P1 representing the damping pressure D. The second parameter value and a rotation pressure reference value Rref are applied to a third device 130 arranged to determine a deviation ΔR between the second parameter value R2 and the rotation pressure reference value Rref. The deviation ΔR is applied to a fourth device 140 arranged to determine a damping pressure reference value Dref depending on the above deviation. The damping pressure reference value Dref and the first parameter value P1 are then applied to a fifth device 150 arranged to regulate the percussion pressure S based on a function of the above damping pressure reference value and the first parameter value P1.

Figure 7:
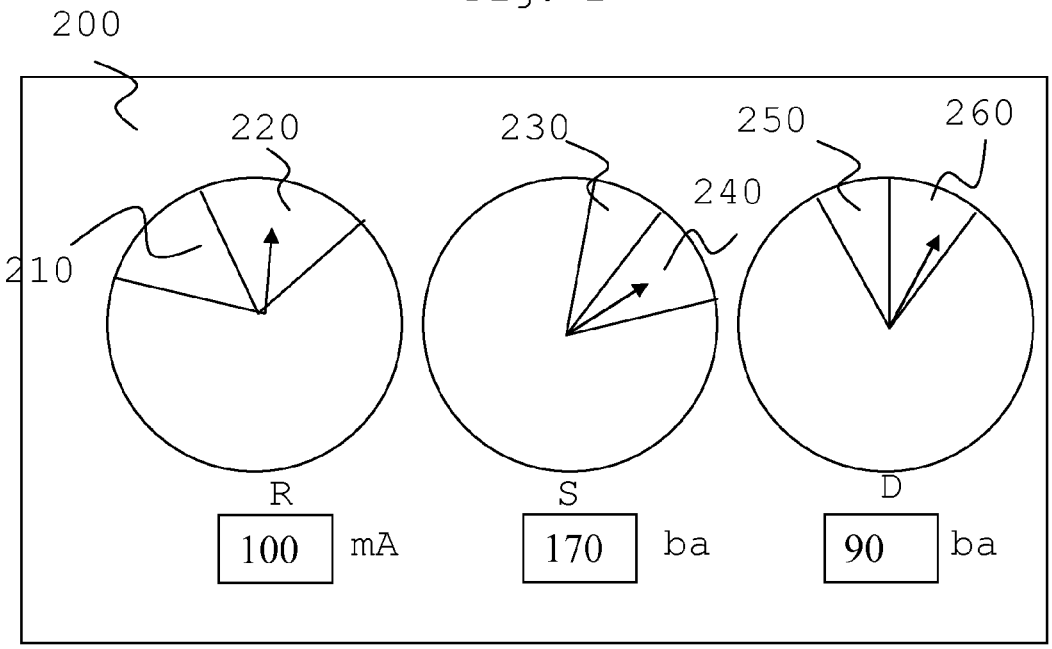
FIG. 6 shows an example of a detail of a control system according to the invention and FIG. 7 shows an example of a display for regulating percussion pressure according to FIG. 5.

FIG. 7 shows an example of a display 200 for regulating percussion pressure according to FIG. 5 with a manometer for each of rotation pressure, percussion pressure and damping pressure. The collaring pressure is in the area 230. During normal drilling, i.e. when the rotation pressure and damping pressure are in the areas in the manometers represented by the reference values 210, 260. This means that the rotation pressure is below the setpoint value for rotation pressure R2 and the damping pressure is above the damping pressure reference level Dref2. In this case, the present invention will not affect the system.

Under the conditions that the rotation pressure increases from the area represented by 210 to the area represented by 220, the control system has started to reduce the feed pressure with the second control function. This causes the damping pressure to fall as the rock contact is not as good. With the method in accordance with the invention, the damping pressure reference value is now reset to Dref2 and the percussion pressure may be retained at normal drilling pressure S2, 240. In the Figure, Dref1 corresponds to the maximum level for the area represented by 260 and the second damping pressure reference level Dref2 corresponds to the maximum level for the area represented by 250.

The invention is not limited to the embodiments shown. Experts may, of course, modify it in a number of ways within the framework of the invention defined by the claims.

The invention claimed is:

1. A method for controlling at least one drill parameter when drilling in rock with a rock drill, said rock drill comprising an impulse-generating device arranged to induce shock waves in a tool acting against the rock with a percussive force generated via a percussion pressure, a rotation-generating device arranged to supply a torque to an impact device with a rotation generated via a rotation pressure, and a pressurisable damping chamber arranged to at least partially regulate contact of the rock drill with the rock via a damping pressure in the damping chamber, wherein said method includes the steps of:

determining a first parameter value (P1) representing the damping pressure (D), determining a second parameter value (P2) representing the rotation pressure (R) of the drill bit, determining a deviation (ΔR) between the above second parameter value and a rotation pressure reference value (Rref), maintaining or changing a damping pressure reference value (Dref, Dref1, Dref2) in dependence on said deviation, and regulating the percussion pressure (S) based on a function of the first parameter value (P1) and the damping pressure reference value.

2. A method in accordance with claim 1, wherein the rotation pressure (R) is determined continuously and/or at specific intervals via sensing, monitoring, measurement or calculation.

3. A method in accordance with claim 2, wherein said function consists of one or more of the following: proportional regulation, derivative regulation, integral regulation in relation to the deviation (ΔR) and/or the damping pressure reference value (Dref, Dref1, Dref2), or a combination thereof.

4. A method in accordance with claim 2, in connection with which the regulation is carried out by means of a mathematical relation between the damping pressure, the rotation pressure and the percussion pressure and/or by referring to a predetermined table.

5. A method in accordance with claim 2, in connection with which the regulation is carried out by means of a mathematical relation between a feed pressure, the rotation pressure and the percussion pressure and/or by referring to a predetermined table.

6. A method in accordance with claim 2, also including the step of regulating the percussion pressure in relation to the start drilling pressure (S1) when the first parameter value (P1) is less than the damping pressure reference value (Dref).

7. A method in accordance with claim 2, also including the step of regulating the percussion pressure (S) in relation to a predetermined drilling pressure (S2) when the second parameter value (P2) is greater than the rotation pressure reference value (Rref) and the first parameter value (P1) is greater than the damping pressure reference value (Dref) set to a second damping pressure reference value (Dref2).

8. A method in accordance with claim 1, wherein said function consists of one or more of the following: proportional regulation, derivative regulation, integral regulation in relation to the deviation (ΔR) and/or the damping pressure reference value (Dref, Dref1, Dref2), or a combination thereof.

9. A method in accordance with claim 1, in connection with which the regulation is carried out by means of a mathematical relation between the damping pressure, the rotation pressure and the percussion pressure and/or by referring to a predetermined table.

10. A method in accordance with claim 1, in connection with which the regulation is carried out by means of a mathematical relation between a feed pressure, the rotation pressure and the percussion pressure and/or by referring to a predetermined table.

11. A method in accordance with claim 1, also including the step of regulating the percussion pressure in relation to the start drilling pressure (S1) when the first parameter value (P1) is less than the damping pressure reference value (Dref).

12. A method in accordance with claim 1, also including the step of regulating the percussion pressure (S) in relation to a predetermined drilling pressure (S2) when the second parameter value (P2) is greater than the rotation pressure reference value (Rref) and the first parameter value (P1) is greater than the damping pressure reference value (Dref) set to a second damping pressure reference value (Dref2).

13. A method in accordance with claim 1, including the step of regulating an increase of percussion pressure such that the increase of percussion pressure per time unit is kept below a threshold value.

14. A method in accordance with claim 1, wherein the rotation-generating device comprises a rotation motor and the second parameter value is a rotation mean value based on the rotation of a drill bit of the rock drill during a predetermined interval of time.

15. A method in accordance with claim 1, including the step of moving the impulse-generating device forwards and backwards along a feeder regulated by a feed pressure (M), and regulating the feed pressure in dependence on the rotation pressure (R).

16. An arrangement for controlling at least one drill parameter when drilling in rock with a rock drill, comprising an impulse-generating device arranged to induce shock waves in a tool acting against the rock with a percussive force generated via a percussion pressure, a rotation-generating device arranged to supply a torque to an impact device with a rotation generated via a rotation pressure, a pressurisable damping chamber arranged to at least partially regulate the contact of the rock drill with the rock via the prevailing pressure in the damping chamber, the percussion pressure being regulated in dependence on the pressure in the damping chamber, and a control system is arranged to control the movement of the rock drill, wherein the arrangement comprises devices for carrying out the method in accordance with claim 1.

17. A computerized control system comprising means for carrying out the method of controlling at least one drill parameter when drilling in rock in accordance with claim 1.

18. A drilling rig, said drilling rig comprising said computerized control system in accordance with claim 17.

19. A computer program downloadable directly into an internal memory of a computer, said computer program comprising program code for controlling the method in accordance with claim 1.

20. A computer-readable medium with a computer program loaded onto it, said computer program being designed to operate a computer to carry out steps in accordance with the method of claim 1.

* * * * *

UNITED STATES PATENT AND TRADEMARK OFFICE

CERTIFICATE OF CORRECTION

PATENT NO. : 8,708,058 B2
APPLICATION NO. : 12/737870
DATED : April 29, 2014
INVENTOR(S) : Jonas Sinnerstad et al.

It is certified that error appears in the above-identified patent and that said Letters Patent is hereby corrected as shown below:

In the Claims

Claim 16, Line 12 (Column 14, Line 33): Delete "is".

Signed and Sealed this
Twenty-fourth Day of June, 2014

Michelle K. Lee

Michelle K. Lee
*Deputy Director of the United States Patent and Trademark Office*